United States Patent [19]

Clark

[11] Patent Number: 4,762,577

[45] Date of Patent: Aug. 9, 1988

[54] 9 CHROMIUM- 1 MOLYBDENUM STEEL ALLOY HAVING SUPERIOR HIGH TEMPERATURE PROPERTIES AND WELDABILITY, A METHOD FOR PREPARING SAME AND ARTICLES FABRICATED THEREFROM

[75] Inventor: Robert E. Clark, Orlando, Fla.

[73] Assignee: Westinghouse Electric Corp., Pittsburgh, Pa.

[21] Appl. No.: 8,971

[22] Filed: Jan. 30, 1987

[51] Int. Cl.[4] ..... C22C 38/22

[52] U.S. Cl. ..... 148/325; 148/334; 420/68; 420/105

[58] Field of Search ..... 148/325, 334; 428/683; 420/67–69, 105, 108, 110, 111, 124

[56] References Cited

U.S. PATENT DOCUMENTS 3,139,337 6/1964 Boyle et al. ..... 420/68
4,404,041 9/1983 Akahori et al. ..... 148/2
4,414,024 11/1983 Siga et al. ..... 75/126 C
4,477,280 10/1984 Shiga et al. ..... 75/124
4,564,392 1/1986 Ohhashi et al. ..... 75/128 V

*Primary Examiner*—Christopher W. Brody

[57] ABSTRACT

Forgings fabricated from 9 Chromium - 1 Molybdenum, modified alloys are subjected to tempering at a temperature less than the ASTM specified minimum tempering temperature in the range from about 1275° F. to about 1300° F. for a period of time in the range of from about 5 to about 20 hours to cause the forging to have a room temperature yield strength in the range from about 85 to about 100 ksi. Such room temperature yield strengths permit the use of the alloy in the fabrication of high-pressure steam turbine rotors. Forgings fabricated from such alloys possess excellent high-temperature properties and the same are also weldable to facilitate repair of rotors fabricated therefrom and to facilitate the fabrication of the rotor in the first instance by forming the rotor from smaller sections which may be welded together and subsequently tempered at a temperature in the range from about 1275° F. to about 1300° F.

2 Claims, 2 Drawing Sheets

9 CHROMIUM- 1 MOLYBDENUM STEEL ALLOY HAVING SUPERIOR HIGH TEMPERATURE PROPERTIES AND WELDABILITY, A METHOD FOR PREPARING SAME AND ARTICLES FABRICATED THEREFROM

BACKGROUND OF THE INVENTION

1. Field of the Invention

This invention relates to 9 Chromium - 1 Molybdenum, modified steel alloys having superior high temperature properties and weldability, methods for preparing such alloys and articles produced therefrom. In particular, the present invention relates to a method for heat treating such alloys to increase the high-temperature strength thereof and weldability of forgings fabricated therefrom and to high-pressure steam turbine rotors fabricated from such forgings.

2. Description of the Related Art

In a paper published Apr. 7, 1982, authored by P. Patriarca and entitled "Modified 9Cr1Mo Steel Technical Program and Data Package for Use in ASME Section 1 and VIII Design Analysis", the Oak Ridge National Laboratory (ORNL) presented a significant amount of technical data on their new 9 Chromium - 1 Molybdenum, modified (9Cr-1Mo, mod.) alloy. This new ORNL alloy was a modification, of existing 9Cr-1Mo alloys. These new modifications which were made to the chemical composition of 9Cr-1Mo alloys by the ORNL, resulted in a significant increase in the high-temperature properties of the alloy. The new ORNL 9Cr-1Mo, mod. steel alloy is now commercially available as an ASTM standard specification, as set forth in Table 1.

TABLE 1

Details of commercial ASTM forging specification for ORNL 9Cr—1Mo, mod.

| Specification | |
|---|---|
| ASTM A-182, F91 | |
| Chemistry | |
| Element | Range (wt %) |
| C | 0.08–0.12 |
| Mn | 0.30–0.50 |
| Si | 0.2–0.5 |
| P | 0.02 max |
| S | 0.01 max |
| Cr | 8–9.5 |
| Ni | 0.4 max |
| Mo | 0.85–1.05 |
| Cu | 0.1 max |
| V | 0.18–0.25 |
| Nb | 0.06–0.10 |
| N | 0.03–0.07 |
| Al | 0.04 max |
| Tensile and Hardness Requirements | |
| Tensile Strength, min. ksi | 85 |
| Yield Strength, min. ksi | 60 |
| % Elongation, min. | 20 |
| Reduction of Area, min. | 40 |
| Brinell Hardness Number, max. | 248 |
| Heat Treatment | |
| Normalized - 1900 to 2000° F. | |
| Tempered - 1350° F. minimum | |

The principal aim of the ORNL in developing the 9Cr-1Mo, mod. alloy described in Table 1 was to produce an alloy having significant improvement in high-temperature strength, toughness, and corrosion resistance over the prior 2¼ Cr-1Mo pressure vessel steel. The ORNL anticipated that the new 9Cr-1Mo, mod. alloy would find use in the fabrication of boiler tubes, miscellaneous boiler components and for general replacement of 2¼ Cr-1Mo pressure vessel parts.

Conventionally, rotors for high-pressure steam turbines have been fabricated from Chromium-Molybdenum-Vanadium (Cr-Mo-V) alloy forgings. Because of already known design requirements, it is highly desirable that the room temperature yield strength for such Cr-Mo-V rotors should be in the range of from about 85 to about 100 ksi. However, as is seen in Table 1, the ORNL 9Cr-1Mo, mod. alloy steel as set forth in ASTM specification A-182, F91 (Table 1), may have a yield strength of only approximately 60 ksi. Accordingly, at least on the face of it, the ORNL 9Cr-1Mo, mod. alloy steel would not be useful in connection with the fabrication of high-pressure steam turbine rotors. On the other hand, as is well known in the art to which the present invention applies, design engineers continually search for improved materials to upgrade turbine construction and in particular to increase the nominal operating life of the overall turbine installation. The present invention is a result of such search.

SUMMARY OF THE INVENTION

The present invention provides a method for improving the high-temperature properties and weldability of 9 Chromium - 1 Molybdenum, modified steel alloys. In particular, the invention provides a method for improving the high-temperature properties and weldability of 9Cr-1Mo, mod. alloys comprising subjecting a body formed from such alloy to tempering at a temperature below the ASTM A-182, F91 specified 1350° F. minimum tempering temperature in the range from about 1275° F. to about 1300° F. More specifically, the invention provides a method for preparing a 9Cr-1Mo, mod. alloy forging having a room temperature yield strength in the range of from about 85 to about 100 ksi comprising subjecting such forging to tempering at a temperature in the range from about 1275° F. to about 1300° F. for a period of time sufficient to produce the desired yield strength. Such period of time generally ranges from 5 to 20 hours. In a particularly preferred form of the invention, the forging so heat treated is used as a component of a high-pressure steam turbine rotor.

In another aspect of the invention, the invention provides a method for fabricating a high-pressure steam turbine rotor comprising providing at least two 9Cr-1Mo, mod. alloy forging sections having a room temperature yield strength in the range from about 85 to about 100 ksi as a result of having been tempered at a temperature in the range of from about 1275° F. to about 1300° F. for a sufficient period of time to produce such yield strength, and welding such forging sections together as a step in producing a rotor. In another aspect of the invention, the same provides a weldable forging formed from 9Cr-1Mo, mod. alloy which has a room temperature yield strength in the range from about 85 to about 100 ksi. As before, in a particular preferred aspect of the invention, the weldable forging having such yield strength may be used as at least a portion of a high pressure steam turbine rotor.

In yet another aspect of the invention, the same provides a high-pressure steam turbine rotor which has been fabricated by welding at least two smaller forging sections together, such sections having been formed of a 9Cr-1Mo, mod. alloy having a room temperature yield strength in the range from about 85 to about 100 ksi as a result of having been tempered at a temperature in the range from about 1275° F. to about 1300° F. for a period of time sufficient to produce such yield strength.

In a more generalized form of the invention, the same provides a weldable forging formed from a 9Cr-1Mo, mod. alloy which has been subjected to tempering under such conditions. The invention also provides a high-pressure steam turbine rotor fabricated utilizing such weldable forging as a component thereof. Finally, in its most preferred aspect, the invention provides a high-pressure steam turbine rotor fabricated of a weldable 9Cr-1Mo, mod. alloy having a room temperature yield strength in the range of from about 85 to about 100 ksi as a result of having been tempered at a temperature in the range from about 1275° F. to about 1300° F. for a period of time sufficient to produce such yield strength.

BRIEF DESCRIPTION OF THE DRAWINGS

This invention can be best understood by reference to the following drawings, in which.

DESCRIPTION OF THE PREFERRED EMBODIMENTS

Figure 1:
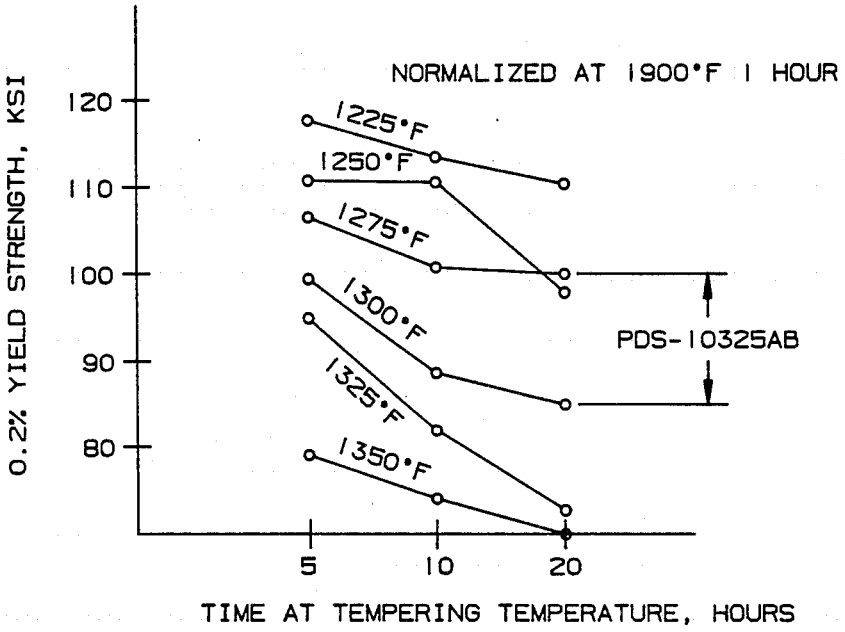
FIG. 1 is a graph charting the relationship between tempering temperature and yield strength of 9Cr-1Mo, mod. steel alloy.

As set forth above, the present invention has, as one of its principal aims, the improvement of the efficiency of the high-pressure components of steam turbines. Such improvement will enable the turbine to be subjected to higher operating temperatures, and at the same time will improve the operating characteristics of the turbine by permitting components to be constructed with lesser thicknesses, resulting in decreased weight and decreased energy losses. Additionally, it is desirable for high pressure components, such as rotors, to be amenable to repair welding to correct in-service degradation. In accordance with the present invention, a weldable 9Cr-1Mo, mod. alloy is heat treated in a novel manner to provide exceptional high-temperature properties which exceed the current Cr-Mo-V high-pressure rotor industry standards. Moreover, the novel heat treatment of the present invention provides a highly weldable turbine rotor alloy which can be readily repair welded and/or fabricated in the first instance by welding small forging sections together to form a full-size rotor.

Current industry standards for Cr-Mo-V alloys useful for fabrication of high-pressure steam turbine rotors are outlined in an article authored by V. P. Swaminathan and R. I. Jaffee, entitled "Significant Improvements in the Properties of Cr Mo V Rotors by Advanced Steel Making," presented at the EPRI Conference in Raleigh, North Carolina on Sept. 12, 1984. Typically, the Cr-Mo-V alloys useful in connection with the fabrication of high-pressure steam turbine rotors should have the following average characteristics:

| 0.2% YS, ksi | UTS, ksi | % El | % RA |
|---|---|---|---|
| 91 | 114 | 19 | 54 |

Unexpectedly, and in accordance with the present invention, it has been found that with the employment of a tempering temperature which is lower than the 1350° F. minimum tempering temperature specified in ASTM A-182, F91, the 9Cr-1Mo, mod. steel alloys may be caused to have a yield strength in the range of from about 85 to about 100 ksi, and to also have exceptional high-temperature properties which are at least equivalent to, if not better than, the high temperature properties of conventional Cr-Mo-V alloys steels. Moreover, it has been determined that a 9Cr-1Mo, mod. steel alloy which is heat treated under the conditions provided by the present invention has vastly improved weldability when compared with either ASTM A-182, F91 standard 9Cr-1Mo, mod. steel alloys or conventional Cr-Mo-V steel alloys.

To provide the improved properties possessed by the 9Cr-1Mo, mod. steel alloy of the present invention, and in particular to provide a room temperature yield strength in the range from about 85 to 100 ksi, the 9Cr-1Mo, mod. alloy is tempered at a lower tempering temperature than that which is specified in ASTM A-182, F91 (see Table 1). In particular, the alloy is tempered at a temperature from about 1275° F. to about 1300° F. for a sufficient period of time to obtain a room temperature yield strength in the range from about 85 to about 100 ksi. This is to be contrasted with the ASTM A-182, F91 (Table 1) specified minimum tempering temperature of 1350° F. and a yield strength which may be as low as 60 ksi, as set forth in such ASTM specification.

The results of several experiments conducted on 9Cr-1Mo, mod. steel alloy to define the heat treatment necessary to obtain room temperature yield strengths in the range from about 85 to about 100 ksi in accordance with the invention are shown in FIG. 1. These data show that the following times and temperatures will produce the desired yield strengths:

| Yield Strength, KSI | Temperature, °F. | Time at Temperature, Hours |
|---|---|---|
| 101 | 1275 | 10 |
| 100 | 1275 | 20 |
| 99 | 1300 | 5 |
| 89 | 1300 | 10 |
| 85 | 1300 | 20 |

Thus, by ignoring the ASTM A-182, F91 specified minimum tempering temperature of 1350° F. and instead tempering the 9Cr-1Mo, mod. alloy at a temperature in the range of from about 1275° F. to about 1300° F., the yield strength of the alloy is increased from a nominal 60 ksi and instead is in the range of from about 85 to about 100 ksi. Accordingly, the 9Cr-1Mo, mod. steel alloy is caused to have a yield strength which is suitable in accordance with the conventional and current Cr-Mo-V rotor room-temperature design requirements.

Several miscellaneous plate and ring forgins were obtained from the Bethlehem Steel Corporation to evaluate 9Cr-1Mo, mod. steel alloys having yield strengths in the range from about 85 to about 100 ksi in accordance with the present invention. These forging were fabricated from Bethlehem's heat no. 125C526V and each forging weighed approximately 50,000 pounds. Testing of these forgings provided the following data:

| Forging | YS (.2%) ksi | UTS, ksi | % El | % RA |
|---|---|---|---|---|
| Plate | 92.5 | 112.0 | 21.0 | 66.0 |
| Plate | 95.5 | 114.0 | 24.0 | 68.0 |
| Ring | 87.5 | 107.0 | 22.0 | 69.0 |
| Ring | 88.0 | 107.0 | 22.0 | 68.0 |

Heat 125C526V was electric-furnace vacuum melted and met the chemistry range requirements of ASTM A-182 - F91 (Table 1). The forgings were tempered at a temperature of about 1300° F. for about 14 hours. These data show that 9Cr-1Mo, mod. steel alloys, when heat treated in accordance with the present invention, have a tensile ductility which is even better than that of Cr-Mo-V alloy steel at the same strength level.

In addition, charpy V-notch toughness tests were conducted on both materials and these tests show that 9Cr-1Mo, mod. alloy steel which has been tempered in accordance with the present invention has improved toughness characteristics when compared with conventional Cr-Mo-V alloy steels. The data from such toughness tests are as follows:

| | Cr—Mo—V | 9Cr—1Mo, mod. |
|---|---|---|
| Energy at 75° F., ft. lb. | 11 | 74 |
| Upper Shelf Energy, ft. lb. | 75 | 137 |
| $FATT_{50}$, °F. | 187 | 70 |

At the present time, creep-to-rupture tests are in progress on the 9Cr-1Mo, mod. steel alloy which has been heat treated in accordance with the present invention. The test conditions and results to date are set forth in Table 2 and charted in FIG. 2, where they are compared to the conventional Cr-Mo-V rotor alloy data base. These tests indicate that 9Cr-1Mo, mod. alloy steel, which is heat treated in accordace with the present invention, has a significant potential for improved creep strength as compared to conventional Cr-Mo-V alloy steels.

Figure 2:
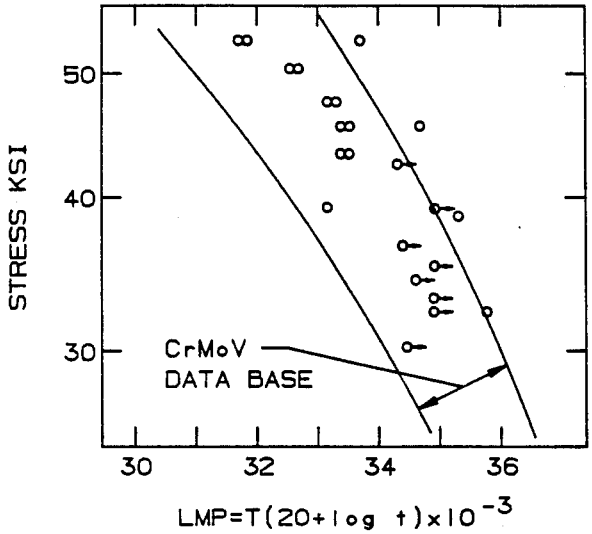
FIG. 2 is a graph charting creep-rupture test data for 9Cr-1Mo, mod. base metal which has been heat treated to provide a yield strength of 85 to 100 ksi.
Figure 3:
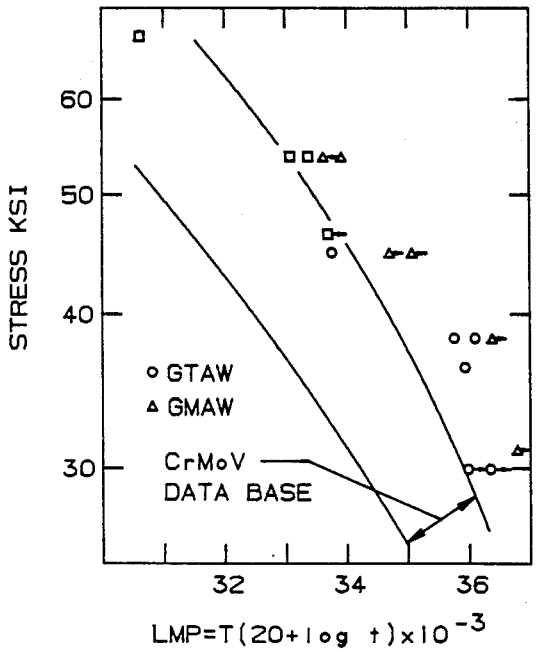
FIG. 3 is a graph charting creep-rupture test data for 9Cr-1Mo, mod. gas tungsten arc and gas metal weld metal which has not been subjected to post weld heat treatment.

In FIGS. 2 and 3, stress, in ksi, is plotted against the Larson-Miller Parameter (LMP) which is defined as being equal to $T(20+\text{Log } t)\times 10^{-3}$ wherein T is the temperature in degrees Rankine (°R) and t is the rupture time in hours. The two lines running from lower right to upper left across each chart define a conventional data base of creep rupture characteristics for acceptable Cr-Mo-V steel alloys. These lines have been developed emperically from known Cr-Mo-V alloys and are used as a standard for defining desirable creep strength characteristics for rotors for high-pressure steam turbine applications. Desirably, such rotors should be fabricated from forgings having Larson-Miller creep rupture parameters at least as great as the left hand line in these Figures and conventional Cr-Mo-V alloys usually have an LMP between the lines. It can be seen from FIG. 2, that in several of the ongoing tests with 9Cr-1Mo, mod. alloys, the LMP is already at or beyond the upper conventional data base parameter for Cr-Mo-V alloys and many of the test pieces have not yet ruptured. Accordingly, such 9Cr-1Mo, mod. alloys have superior creep rupture characteristics than do conventional Cr-Mo-V alloys.

TABLE 2

Creep-rupture test results for 9Cr—1Mo, mod. base metal heat treated to to 100 ksi yield strength.

TABLE 2-continued

| Test Temp, °F. | Stress, KSI | Estimated Rupture Time, Hr | Rupture Time, Hr | Percent Deformation |
|---|---|---|---|---|
| 1000 | 38 | 1,000 | 7779* | 1.4 |
| 1000 | 35 | 2,000 | 7779* | 0.8 |
| 1000 | 33 | 5,000 | 7779* | 0.7 |
| 1000 | 32 | 10,000 | 7779* | 0.6 |
| 950 | 53 | 500 | 7972 | 18 |
| 1000 | 45 | 500 | 5735 | 22 |
| 1050 | 38 | 500 | 2505 | 18 |
| 1100 | 32 | 500 | 869 | 40 |

*Discontinued as of 7/18/86.

Additional Data

| Specimen Number | Test Temp, °F. | Stress, KSI | Estimated Life, Hr. | Time to Failure, Hr. | % EL | % RA |
|---|---|---|---|---|---|---|
| 1 | 950 | 53 | 500 | 469 | 28 | 80 |
| 2 | 950 | 53 | 500 | 311 | 30 | 30 |
| 3 | 950 | 50 | 1,000 | 1439 | 26.2 | 75.7 |
| 4 | 950 | 50 | 1,000 | 1549 | 20.8 | 71.5 |
| 5 | 950 | 47 | 2,000 | 3772* | 1.9 | |
| 6 | 950 | 47 | 2,000 | 3782* | 1.7 | |
| 7 | 950 | 43 | 5,000 | 5552** | 0.9 | |
| 8 | 950 | 43 | 5,000 | 5552** | 0.8 | |
| 9 | 950 | 39 | 10,000 | 3843* | 0.5 | |
| 10 | 950 | 39 | 10,000 | 3843* | 0.5 | |
| 11 | 950 | 36 | 20,000 | 3843* | 0.4 | |
| 12 | 950 | 36 | 20,000 | 3843* | 0.4 | |
| 13 | 1000 | 45 | 500 | 739 | 27 | 80 |
| 14 | 1000 | 45 | 500 | 871 | 31 | 81 |
| 15 | 1000 | 42 | 1,000 | 3217 | 24.3 | 73.4 |
| 16 | 1000 | 42 | 1,000 | 3651 | 22.3 | 76.8 |
| 17 | 1000 | 36 | 2,000 | 3782* | 0.7 | |
| 18 | 1000 | 36 | 2,000 | 3786* | 0.8 | |
| 19 | 1000 | 34 | 5,000 | 5552** | 0.7 | |
| 20 | 1000 | 34 | 5,000 | 5552** | 0.8 | |
| 21 | 1000 | 30 | 10,000 | 3837* | 0.4 | |
| 22 | 1000 | 30 | 10,000 | 3836* | 0.5 | |
| 23 | 1000 | 27 | 20,000 | 3843* | 0.3 | |
| 24 | 1000 | 27 | 20,000 | 3843* | 0.3 | |

*Discontinued
**Running as of 10/31/86

Significant testing has been conducted to evaluate the weldability and high-temperature properties of standard ASTM A-182, F91 9Cr-1Mo, mod. alloy steels. This alloy has proven to be highly weldable using gas tungsten arc welding (GTAW) or gas metal arc welding (GMAW) processes and filler metals having the same chemical composition. Results of these tests are set forth in Table 3 and shown in FIG. 3.

TABLE 3

Creep-rupture test results for 9Cr—1Mo, mod. gas tungsten arc weld and gas metal arc metals postweld heat treated to 85 to 100 KSI YS.

| | Test Temp, °F. | Stress, KSI | Estimated Rupture Time, Hr. | Rupture Time, Hr. | % Elongation |
|---|---|---|---|---|---|
| GTAW | 950 | 53 | 500 | 2907 | 21 |
| | 950 | 53 | 500 | 4334 | 26 |
| | 950 | 46 | 2000 | 6858 | 18 |
| | 950 | 46 | 2000 | 7486* | 2 |
| | 1050 | 38 | 500 | 7324 | 17 |
| | 1050 | 38 | 500 | 4668 | 14 |
| | 1050 | 30 | 500 | 7460* | 3 |
| | 1050 | 30 | 500 | 9185** | — |
| GMAW | 950 | 53 | 500 | 6573* | — |
| | 950 | 53 | 500 | 8373 | 10 |
| | 1000 | 45 | 500 | 12,365* | — |
| | 1000 | 45 | 500 | 5841** | — |
| | 1050 | 38 | 500 | 11,021* | — |
| | 1100 | 32 | 500 | 5033* | — |

*Discontinued
**Running as of 10/31/86

The foregoing data illustrate that the creep strengths for 9Cr-1Mo, mod. steel alloy welds which have been subjected to postweld heat treatment in accordance with the present invention to provide a yield strength in the range of from about 85 to about 100 ksi, are much higher than the creep strengths of the conventional, currently utilized Cr-Mo-V rotor alloy materials. It is also postulated that the LMP creep strengths of such heat treated 9Cr-1Mo, mod. alloy welds will be higher than those provided by standard ASTM A-182, F91 weldments which have been subjected to postweld heat treatment at a minimum temperature of 1350° F. to thereby provide nominal yield strengths in the order of 60 ksi.

Accordingly, 9Cr-1Mo, mod. alloys which have been heat treated in accordance with the present may be used for fabrication of high-pressure steam turbine rotors. Such rotors possess acceptable high-temperature properties and excellent weldability characteristics. Moreover, the properties of the 9Cr-1Mo, mod. alloys of the present invention make possible the fabrication of high-pressure turbine rotors by the welding together of smaller 9Cr-1Mo, mod. forgings using 9Cr-1Mo, mod. weld metal and subsequently heat treating the composite article at a tempering temperature less than 1350° F. in accordance with the invention.

I claim:

1. A high-pressure steam turbine rotor fabricated by welding at least two forging sections together, said sections being formed of a 9Cr-1Mo, mod. alloy having a chemical constituency as set forth in ASTM specification A-182, F-91 and a room temperature yield strength in the range of from about 85 to about 100 ksi as a result of having been tempered at a temperature in the range of from about 1275° F. to about 1300° F. for a period of time sufficient to produce such yield strength.

2. A high-pressure steam turbine rotor fabricated at a weldable 9Cr-1Mo, mod. alloy having a room temperature yield strength in the range of from about 85 to about 100 ksi as a result of having been tempered at a temperature in the range of from about 1275° F. to about 1300° F. for a period of time sufficient to produce such yield strength.

* * * * *